US005896671A

United States Patent [19]

Yu

[11] Patent Number: 5,896,671

[45] Date of Patent: Apr. 27, 1999

[54] UNIVERSAL SCALE AND CONVERSION TOOL

[76] Inventor: Weiping Yu, 1049 Fifth St. SE., Minneapolis, Minn. 55414

[21] Appl. No.: 08/803,949

[22] Filed: Feb. 21, 1997

[51] Int. Cl.[6] ..... G06G 1/02; G06C 1/00

[52] U.S. Cl. ..... 33/15 B; 33/15 D; 33/663; 33/562

[58] Field of Search ..... 33/15 B, 1 B, 33/1 BB, 150, 663, 665, 562

[56] References Cited

U.S. PATENT DOCUMENTS

| | | | |
|---|---|---|---|
| 2,653,387 | 9/1953 | Cameron | 33/1 SB |
| 3,507,045 | 4/1970 | Rives . | |
| 3,812,586 | 5/1974 | Itokawa | 33/1 SD |
| 4,117,313 | 9/1978 | Vincent | 33/1 SD |
| 4,208,804 | 6/1980 | Lundin | 33/418 |
| 4,265,425 | 5/1981 | Senno et al. | 33/477 |
| 4,707,928 | 11/1987 | Bennett et al. | 33/491 |
| 4,736,526 | 4/1988 | Hsia | 33/565 |
| 4,750,270 | 6/1988 | Kundikoff | 33/494 |
| 5,058,285 | 10/1991 | Morita et al. | 33/563 |

*Primary Examiner*—Christopher W. Fulton
*Attorney, Agent, or Firm*—Schwegman, Lundberg, Woessner & Kluth, P.A.

[57] ABSTRACT

The present invention relates to a measuring device, conversion device or ruler having specifically or universally selectable scales which can be used to measure distances with a desired linear or logarithmic scale, to draw distances to a desired scale, or to divide distances into a desired number of equal parts. The ruler comprises a transparent support plate having special graduations which are either composed of parallel, equally spaced lines or parallel logarithmically spaced straight lines, or composed of inclined angularly spaced lines. In the instance where the lines are angularly spaced, as in a ray-like structure, it may be composed of rays of inclined, straight or curved lines, said inclined lines or their extensions having a common intersection and the spacings between any two neighboring lines being equidistant, regularly increasing, or logarithmic-related distances in at least one direction. A specific scale may be selected by rotating the ruler to a certain degree of angle as is in the former cases or by moving it parallel to a certain position as in the later cases.

12 Claims, 7 Drawing Sheets

UNIVERSAL SCALE AND CONVERSION TOOL

BACKGROUND OF THE INVENTION

1. Field of the Invention

The present invention relates to a measuring device or conversion tool which has wide applicability to the reading of scale representations, such as graphs, charts, maps and the like, independent of the scale or units used in the graph, chart or map. The present invention particularly relates to a device which can be used in the reading of scale representations by lay persons or highly skilled technical staff with ease and precision.

The device of the present invention can be considered in some formats as a ruler having universally selectable scales which can be used to measure distances with a desired linear or logarithmic scale, to draw distances to a desired scale, or to divide distances into a desired number of equal parts.

2. Background of the Art

Since the origination of graphic representations, there has always been a need for balancing the level of complexity in the representation to provide all the information that the originator feels is essential with the ease of accessing and reading that information by the widest spectrum of users of the representation. These two characteristics are not always satisfied by the same format or structure of the representation.

One of the earliest conflicts between graphic representation of information and access to users was in the field of cartography. When original globes and maps were made for the purposes of navigation, an initial difficulty was in representing a sphere as a flat surface upon which a navigator could more easily perform measurement tasks necessary for determining directions, speeds and distances necessary for a voyage. The size of the map had to be controlled, with scaling of distances for easier management of the calculations and manipulation of the graph. The scale on a map was a key in which ratios of actual measured distances on the map were related to real distances on the surface of the Earth. For example, a scale on a map might indicate that a specific distance (e.g., 1 inch) was equal to 100 miles. The unit distance on the map and the scale distance did not have to be whole integer units, but in many cases, to simplify the ability of the user to measure distances, accessible units such as 1 inch per 100 miles, etc. were selected. The map was used by a navigator, in some instances, by drawing a line on the map with a straight edge, setting a compass at the fixed unit distance (e.g., 1 inch to represent 100 miles), positioning the point of the compass at the starting point of a trip, rotating the compass from point to point (counting the number of rotations), and ceasing the rotations when an integral number of rotations has been made along the line. The last portion of the last rotation would then be determined as a fraction (e.g., there might have been 9.45 rotations). That fraction of a rotation was then converted to a fraction of the full distance (e.g., 0.45 times 100 miles) and the entire distance then estimated (e.g., 9 times 100 miles plus 0.45 times 100 miles became 945 miles). This system, combined with astronavigation, served the nautical trade adequately for many centuries, but with well known and documented limitations in its performance. With the greater accuracy in maps and navigation, and the complexities of straight-edging a line, marking up original maps, manual inaccuracies created by the drawing and compass rotation, and separate physical measurement of the fractional remains, the system is inconvenient for modern usage, even with its historical and romantic ambiance.

Much preliminary technical work, at the workplace, in estimations, and planning, requires the use of scaled representations in its performance. Similarly, much drafting work in architecture, estimating graph readings in chemical engineering, planning in agriculture, and other fields, requires quick access and conversion of graphs and charts to usable information, without further diminishing of the numerical accuracy of the reading by manual error or complexity.

Conventional rulers contain only a limited number of scales, which are usually selected from the standard series of metric scales, architect scales, or engineer scales. The ruler in U.S. Pat. No. 4,707,928 to Bennett et. al. entitled VARI-SCALE, for example, contains seventeen of the above mentioned scales. A disadvantage of conventional rulers is that the selections of scales are limited to a finite number, say, 17. The consequence is that when a measurement requires a scale other than a conventional scale, the measurement with a conventional ruler becomes difficult and time-consuming. For example, distances on a map or a technical graph are usually predefined by a so-called reference scale which was used to create the map or graph. To measure distances on such a map or a graph, the best way is to use this reference scale directly. With a conventional ruler, however, the distances must be first measured with a standard scale which is, in general, different from the reference scale, and then the reference scale must also be measured with the same standard scale. Third, a conversion relationship between these two different scales must be established, which requires certain mathematical knowledge. Finally, the conversion must be physically carried out, in more difficult cases, by a calculator, and in easier cases, by mental calculation.

Another disadvantage of conventional rulers is that conventional rulers contain only linear scales without logarithmic scales. When a logarithmic type of distance, which usually occurs in a logarithmic type of graph, needed to be measured, the conversion between a linear scale and a logarithmic scale must be conducted. This type of conversion is far more troublesome than a conversion between two linear scales.

A further disadvantage of conventional rulers is to use them to draw distances to a scale not contained in conventional rulers. The conversions between different scales and calculations by a calculator are inevitable.

An additional disadvantage of the conventional rulers is the inability or difficulty in using them to divide a distance or a primary line into an optional number of equal parts. It usually involves dimensional measurement, division and multiplication by a calculator. The ruler means in U.S. Pat. No. 4,208,804 to Lundin titled RULER MEANS FOR DIVIDING A DISTANCE offers an alternative method for doing this but the measurement process with the ruler means is relatively complicated. Moreover, dividing a distance is the only task it performs. To divide a distance or a primary line into equal parts, a rotating arm is placed at a 0,0 axis. A line to an X axis is dropped (by drawing with a straight edge) from the point or end point of the distance or primary line to be divided. The rotating arm is rotated so that the end distal from the 0,0 axis intersects the particular number selected for the number of segments. The rotating arm contains numbers (e.g., 0, 1, 2, 3, 4, . . . . ), and these numbers indicate the position of the cutting lines of the distance or primary line. Secondary lines must be straight-edge drawn to the X axis from the cutting points of the numbers on the rotating arm. These cutting lines are then extended up to the primary line or a working line drawn from the Y axis to the point. These cutting lines then define the segments created in dividing the line or distance into the predetermined number of parts. As can be seen, a significant amount of straight edge work and multiple line drawing must be done. This is complex and introduces significant possibilities for error introduction and lack of precision.

U.S. Pat. No. 4,736,526 to Hsia, titled GEOMETRY TEMPLATE discloses an apparatus in which a clear plastic template bears a combination of inscribed marks and apertures to cooperate with each other to facilitate drawing of common geometric figures. An annexed arm is shown which is attached in an axial manner to a portion of the template so that it may rotate. The annexed arm has numerous holes in it to assist in drawing circles.

U.S. Pat. No. 3,507,045 to Rives, titled RULE WITH INTERCHANGEABLE SCALES discloses a support body into or onto which a plurality of scales may be interchanged. Different scales are attached to the ruler support body for preselected uses.

Other physical structures in ruler form which have premarkings, slots, holes and the like for accurately locating portions of a distance or relative positions include U.S. Pat. No. 4,750,270 to Kundlikoff, titled MEASURING RULER; U.S. Pat. No. 5,847,223 to Krane, titled LINEAR SCALE; and U.S. Pat. No. 5,058,285 to Morita et al., titled TEMPLATE.

U.S. Pat. No. 4,625,425 to Senno et al., titled UNIVERSAL TRIANGLE describes a drafting implement consisting of an interchangeable circular triangle and circular disk, each being imprinted and having measurement and drafting aids to make technical drawings and measurements. Individual disks or templates are inserted for each type of drawing or measurement to be made.

SUMMARY OF THE INVENTION

The present invention relates to a measuring device, conversion device or ruler having specifically or universally selectable scales which can be used to measure distances with a desired linear or logarithmic scale, to draw distances to a desired scale, or to divide distances into a desired number of equal parts. The ruler comprises a transparent support plate having special graduations which are either composed of parallel, equally spaced lines or parallel logarithmically spaced straight lines, or composed of inclined angularly spaced lines. In the instance where the lines are angularly spaced, as in a ray-like structure, it may be composed of rays of inclined, straight or curved lines, said inclined lines or their extensions having a common intersection and the spacings between any two neighboring lines being equidistant, regularly increasing, or logarithmic-related distances in at least one direction. A specific scale may be selected by rotating the ruler to a certain degree of angle as is in the former cases or by moving it parallel to a certain position as in the later cases.

BRIEF DESCRIPTION OF THE DRAWINGS

FIG. 1 (*b*) is a top plan view of a first modification of FIG. 1(*a*), the plate containing English type of graduations which are composed of parallel, equally spaced straight lines;

FIG. 1 (*c*) is a top plan view of a second modification of FIG. 1(*a*), the plate containing logarithmic type of graduations which are composed of parallel, logarithmically spaced straight lines;

FIG. 3(*a*) shows a logarithmic graph (versus linear values). FIG. 3(*b*) shows a Universal Logarithmic Scale overlaying the graph of 3(*a*). FIG. 3(*c*) shows the positioning of the Universal Logarithmic Scale of 3(*b*) over the graph of 3(*a*) after normalization of the scale.

DETAILED DESCRIPTION OF THE INVENTION

Figure 1:
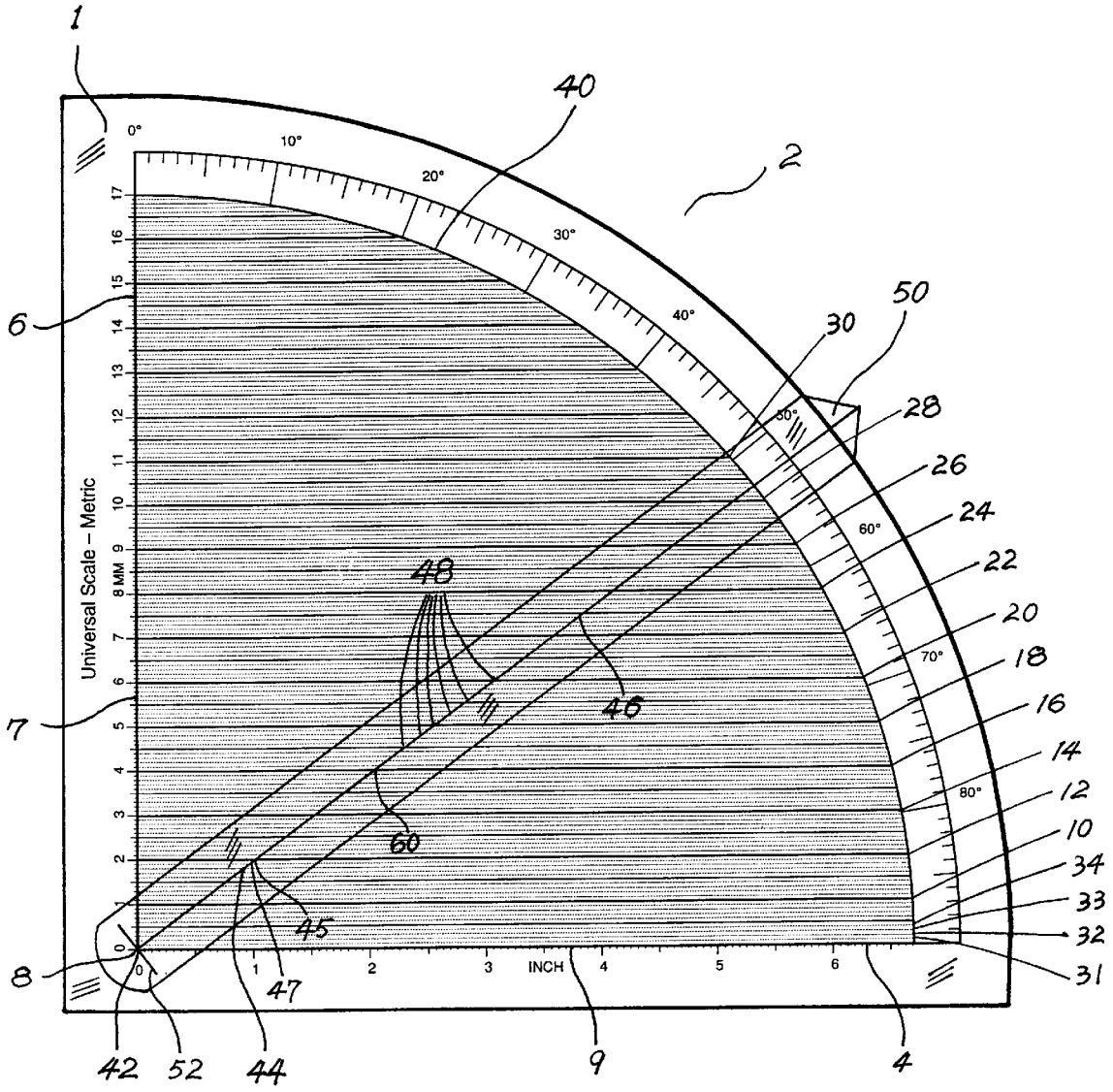
FIG. 1(*a*) is a top plan view of a universal scale ruler according to a preferred embodiment of the invention, the ruler comprising a thin transparent plastic plate and an elongated arm, said plate containing metric type of graduations which are composed of parallel, equally spaced straight lines.
Figure 1:
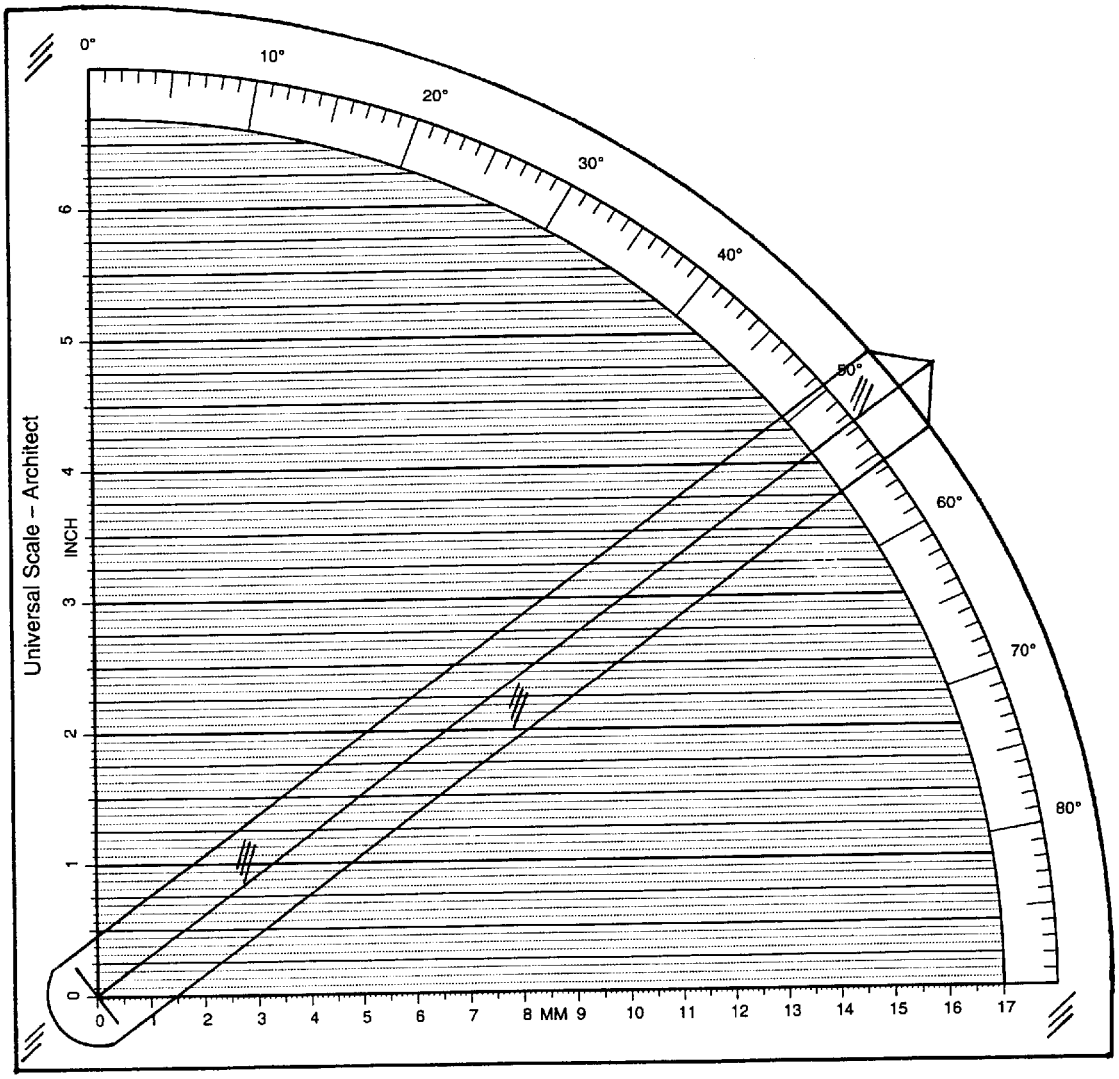
Figure 1:
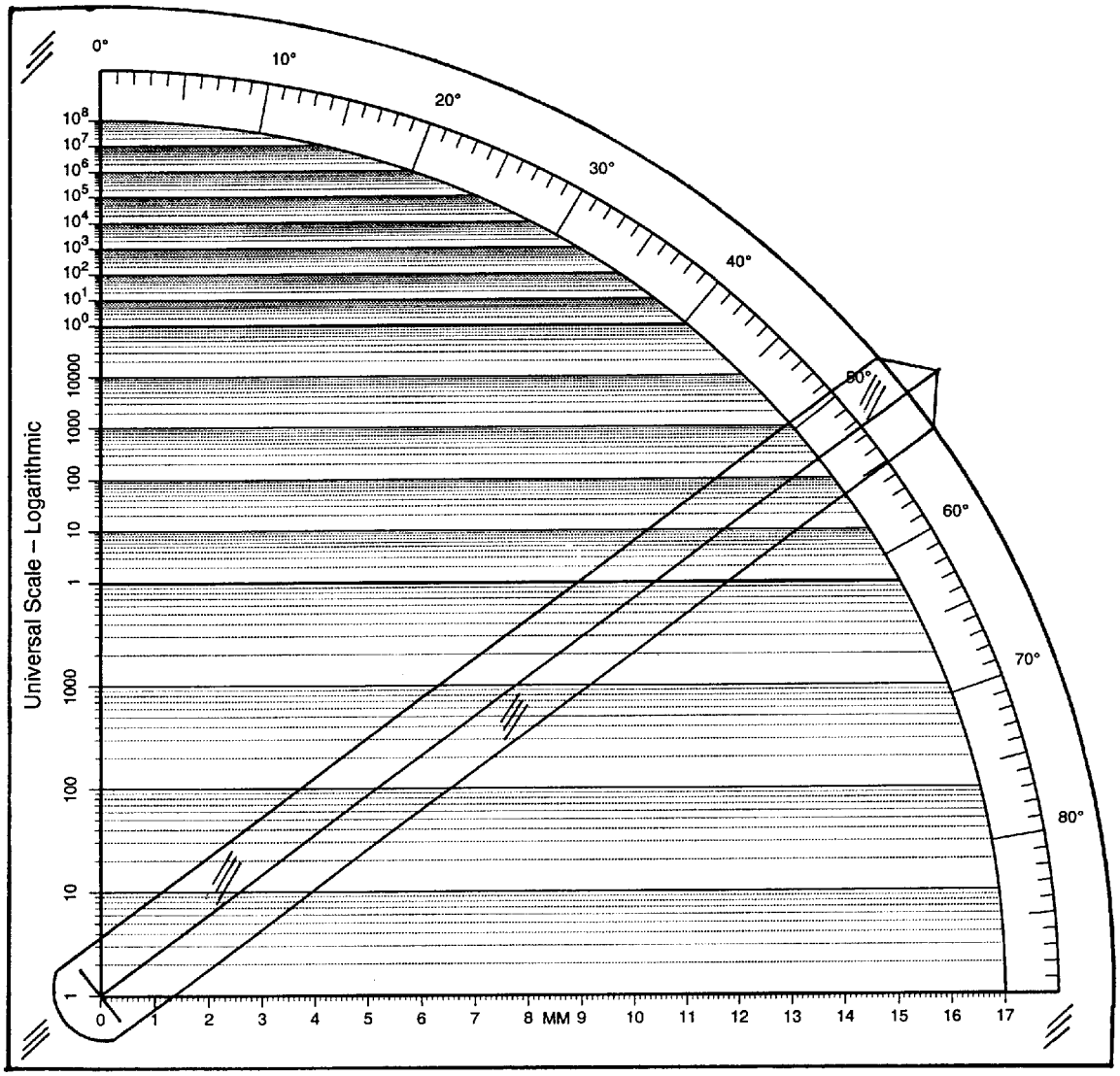

The present invention comprises a scaling device, ruling device or converting device (hereinafter referred to as a "graphic translator") which can be easily used to read information or convert information into an easily readable form. The graphic translator comprises a base member and a pivoting or rotating arm member. Both the base member and the pivoting arm are translucent or transparent, although there will be generally alphanumerics printed, embossed or otherwise displayed on the member and/or the arm which may be locally opaque. The graphic translator will be a relatively flat element, such as a sheet or film. The sheet may be rigid, but is preferably flexible for certain desirable uses. The sheet may comprises glass or ceramics if it is rigid, and may comprise polymeric materials if it is to be either rigid or flexible. Preferred polymeric materials include polyester film of from 2 to 50 mil, preferably from 4 to 40 mil, and more preferably from 6 to 25 mil in thickness. The film or sheet will have an upper side and a lower side. The upper side will have visible lines on it. The image may be printed on either the upper side or the lower side as the film or sheet is transparent or translucent. The polymeric film may be any reasonably durable polymer such as a polyester (polyethylene terephthalate, polyethylene naphthalate), polyamide, polycarbonate, polyvinyl resin (polyvinyl chloride, polyvinylidene chloride, polyvinyl acetate, polyvinyl acetals, and copolymers thereof, etc.), polyolefins, etc. The film base may be particularly chosen to comprise printable film base, particularly laser printable or ink jet printable film base so that base elements may be readily printed from data base. This would be done by providing a polymeric film having a coating thereon which was particularly adapted to printable by a specific process, (usually by application of a coating onto the surface which has high efficiency and strong bonding capability to the imaging material transferred during the image transfer step). It is preferred that the image be printed on the upper side as the lower side will be more likely to receive abrasion during use. The image on the base member will usually appear as a graph having at least an X and a Y axis. In one embodiment of the present invention, there are sets of parallel lines running parallel to one axis of the graph (e.g., the X axis). The parallel lines may appear as major lines (e.g., defining major units, such as 1, 2, 3, or 10, 20, 30, etc., and these major lines may be darker than other parallel lines or use different colors to distinguish the lines) and minor lines (e.g., defining minor or partial units such as 0.1, 0.2 or 0.25, 0.50, or 10°, 20°, etc.). There may be numbers on the axes of each scale, or the scales may be left blank. There is a point where the scales cross (e.g., the 0,0 point on the X,Y scales) which is referred to as the point of axial rotation (the PAR point). A rotating arm is usually fixed at the PAR point. The point attachment of the rotating arm at the PAR point is the axis about which the distal or far end of the rotating arm rotates or pivots.

The invention may also be more particularly described as a universal scale ruler comprising:

a transparent element having a visible figure thereon with at least two axes which intersect at a point, said figure having a family of lines which define a mathematic order with respect to at least a first one of said axes, said mathematic order being represented by parallelity between members of said family of lines or by perspective parallelity, attached to said point where said at least two axes intersect is a rotating arm which rotates about said point where said at least two axes intersect, said rotating arm having visible markings thereon.

The scale may have a second one of said at least two axes also has markings which define an ordered mathematic relationship at then end of said family of lines, particularly where alphanumerics are present along said at least a first one of said axes and said family of lines comprises parallel lines. Visible markings on said rotating arm may comprise numeric intervals and said rotating arm is transparent and said family of lines comprises parallel lines. Each of said at least two axes may connected at a distal position (close to the ends of the axes, for example) by a third axis having alphanumerics along said third axis. Said third axis may comprise an arcuate line having numerical units defining physical spacing between segments of said arcuate line, such as percentages, degrees, fractions, or arbitrary units, e.g., defining physical spacing between segments of said arcuate line.

The invention also includes a method of measuring distances on a map using the universal scale which would comprise:

a) positioning the point at which said at least two axes intersect at a point on a distance scale for said map, b) determining a focus point on said rotating arm which approximates a unit distance between said point on a distance scale and a point on said distance scale underlying said focus point on said rotating arm to establish a scale distance between point at which said at least two axes intersect and said focus point, c) rotating said rotatable arm so that said focus point overlies one of said family of lines, d) without further rotation of said rotatable arm, moving said universal scale to a map using said distance scale, e) placing said point at which said at least two axes intersect over a base point on said map, f) directing said rotating arm so that it crosses over a target point on said map using said distance scale, and g) determining a distance between said base point on said map and said target point on said map by counting a number of the family of lines which said rotating arm crosses between said base point and said target point on said map. The process would usually have said family of lines as parallel lines. It would also be desirable where there are major parallel lines within said family of lines and minor parallel lines between said major parallel lines which subdivide the major parallel lines into smaller units. The major lines would usually be darker or thicker than the minor lines, or would use different colors for easier distinction between them. In the process after step c), the rotating arm is preferably secured into place to reduce its ability to rotate.

Another method within the present inventive process for calculating a measurement on a graph having at least one logarithmic scale thereon might comprise:

a) providing a graph with at least one logarithmic scale thereon, b) providing a universal scale as described above wherein at least one of said at least two axes comprises a logarithmic scale, c) positioning the point at which said at least two axes intersect at a point on a logarithmic axis or logarithmic scale for said graph, d) determining a focus point on said rotating arm which approximates a unit exponential distance between said point on a logarithmic axis or scale and a point on said logarithmic axis or scale underlying said focus point on said rotating arm to establish a scale exponential distance between said point at which said at least two axes intersect and said focus point, e) rotating said rotatable arm so that said focus point overlies one of said family of lines, f) without further rotation of said rotatable arm, moving said universal scale to a graph using said exponential scale, g) placing said point at which said at least two axes intersect over a base point on said graph, h) directing said rotating arm without rotating it with respect to said transparent element so that it crosses over a target point on said graph using said exponential scale, and i) determining a distance between said base point on said graph and said target point on said graph by counting a number of the family of lines which said rotating arm crosses between said base point and said target point on said graph.

The scale of the present invention may be used for direct marking on substrates underneath them where said family of lines comprises slots within said transparent element. A set or series of scales may be included within a single package to enable use of the set for a variety of purposes. A set of universal rulers according to those described above may be provided wherein:

a) there are at least three different transparent elements having a visible figure thereon, each visible figure with at least two axes which intersect at a point, b) said each visible figure having a family of lines which define a mathematic order with respect to at least a first one of said axes, and at least two of said family of lines being different as between at least two of said at least three figures, c) said mathematic order being represented by parallelity between members of said family of lines or by perspective parallelity, d) at said point where said at least two axes intersect is a hole or puncture point for receiving a rotating arm to rotate about said point where said at least two axes intersect. To comprise a set, different figures are provided so that there is more than one function available within each set.

Another method of measuring with a ruler according to the present invention would comprise the steps of:

a) aligning a longitudinal axis of said rotatable arm with a reference scale to be measured by overlaying said rotatable arm on top of an underlying scale, b) rotating said plate until finding a desired scale on the transparent element to define a uniform value on a pictorial representation associated with said scale, and c) measuring values on said pictorial representation directly with the scale.

In a more detailed description of the construction of the present invention, the rotating arm extends away from the PAR point and there may be an arcuate line which the rotating arm crosses which defines another measurement or perspective in the system. The arcuate line may have alphanumerics along the arc, preferably beginning at one axis and progressing towards or to the other axis. For example, the alphanumerics on the arc may define from 0 to 100%, 0 to 90°, 0 to 360°, or any other domain which is desirably recited on that arc. The arc may also have merely reference points along the edge so that the placement of the rotating arm can be better visualized. The arcuate end of the graph may also have a securing or stabilizing feature for fixing the position of the rotating arm once a desired position has been established for that arm. The fixing feature might be as simple as repositionable pressure sensitive adhesive on the underside of a portion of the rotating arm, adhesive on the arcuate section itself, fabric attaches (e.g., Velcro® fasteners), a clip on the end of the rotating arm to clip to the base member, and the like.

One aspect of the present invention is to provide a ruler having universally selectable scales which can be used to measure distances with a desired linear or logarithmic scale, to draw distances to a desired scale, or to divide distances into a desired number of equal parts. This aspect is achieved according to the present invention by providing a ruler comprising a thin transparent plastic plate having at least one set of special graduations which are either composed of equidistant, regularly increasing, or logarithmic-related distances in at least one direction, or composed of a ray of inclined, straight or curved lines, said inclined lines or their extensions having a common intersection and the spacings between any two neighboring lines being equidistant or logarithmic-distant in at least one direction. A specific scale may be selected by rotating the ruler to a certain degree of angle as is in the former cases or by moving it parallel to a certain position as is in the later cases.

Using the ruler thus constructed, the measurement process is simplified, the conversions between different scales and calculations by a calculator or in one's head are minimized, and the accuracy is improved. Furthermore, the straightforward design makes it surprisingly easy to use, with a simple design, ease of manufacture, and low cost to the customer.

The above and other aspects, features and advantages of the present invention will become more apparent from the following descriptions when taken in conjunction with the accompanying drawings in which preferred embodiments of the present invention are shown by way of illustrative example.

A simple case scenario for using the graphic translator 2 of FIG. 1(*a*) will be described. The graphic translator 2 comprises a flat sheet 1 having an X axis 4 and a Y axis 6 as an image thereon. The units of the X axis 4 happen to be shown in avoirdupois units and the units of the Y axis 6 happen to be shown metric units, but no specific or real units are necessary as long as spacing between lines (such as between 31, 32, 33, 34, etc., or between 10, 12, 14, 16, etc.) are even, in this usage. Parallel to the X axis 4 are sets of major lines 10, 12, 14, 16, 18, 20, 22, 24, 26, 28, 30, etc. which A terminates at arcuate line 40. These major lines (10–30) correspond to units on the Y axis 6. A rotating arm 50 is attached to the PAR point 8 at the intersection of the X axis 4 and the Y axis 6. A pin 42 or rivet secures the rotating arm to the PAR point 8.

In reading distances on a map, the graphic translator 2 may be laid over a map (not shown). The rotating arm 50 is laid over the scale or key of the map (not shown), with the PAR point 8 at the 0 value of the scale (not shown). A unit of measurement of the map, such as 100 miles, 100 km, etc. is positioned on a center line 46 of the rotation arm 50. There are unit points 48 along the center line 46. An arbitrary unit point 60 has been identified as the unit point 48 which fell on the end of the scale at the appropriate unit (e.g., 100 miles, 100 km, etc.). It is not essential that a unit point 48 fall exactly on the end of the scale, as the end of the scale can be approximated between unit points also (as done between unit points 45 and 44, with estimated position 47). The rotating arm 50 is then rotated so that the point 60 which identifies the distance on the scale from 0 to the desired unit of measurement is centered over a line. Alternatively, the scale, with the arm in position over this point 60 may be moved over the underlying map (not shown), with the distance between the point 8 and the point 60 indicating a specific distance. This specific distance may be moved about the underlying map not shown) to measure multiples of that specific distance. The arcuate nature of the rotation of the arm assures that the point will cross many lines 10, 12, 14, etc., as long as the distance between the PAR point 8 and point 60 is greater than a single major line unit on the Y axis 6. The graphic translator 2 may now be lifted from the scale of the map and the PAR point 8 located over a desired base location on the map (not shown, but may be a city, for example, Washington, D.C.). The scale unit selected (e.g., the 100 miles, 100 km, etc.) is now carried with the graphic translator 2 with the PAR point 8 being at the center of the selected location. The rotating arm 50 is preferably secured in position relative to the base member (as by means previously discussed, but not here shown). If an underside of the pin 42 is sharp or somewhat pointed, the positioning of the graphic translator is stabilized so that it may be readily moved. If the specific distance to a city on the map is to be sought, a distal portion of the center line 46 is placed over that city, while the PAR point 8 is still located over the base city, e.g., Washington, D.C. As shown in the figure, unit point 60, which equals the unit on the scale, has been arbitrarily chosen to intersect major line 4 on the Y axis 6. Therefore, every four lines along the center line 46 equals the unit on the scale. Each major line equals ¼ of the unit on the scale, or 25 miles. The number of major line between the PAR point 8 and the target city may be counted, and the number of minor lines (e.g., 31, 32, 33, etc.) may be used to more accurately calculate distances between major lines. For example, arbitrary point 44 is one major line 10 and 8 minor lines along the center line 46. That means that a city at point 44 would be one major line (e.g., 25 miles) and 8 minor lines (8 times 2.5 miles) or 45 miles from Washington, D.C. Circles having a defined radius about a location may be readily drawn. Distances readily compared from a central location, and many other quick and accurate readings of maps may be performed by this instrument.

To read the values in an underlying graph or chart with this ruler, the center line 46 on the arm 50 is first brought into alignment with a reference scale on a chart or a graph (not shown), and then a desired scale can be found by rotating the plate to a certain angle. The scale can then be used to measure distances directly on the graph or chart by moving the universal scale over the graph or chart and counting multiples or fractions of the line spacing on the universal scale equated with the units on the underlying graph or chart. In the case of scaling a distance or a primary line to a desired scale, one needs to first find or establish the desired scale on the ruler or between determined points on the rotating arm and the scale (e.g., as in FIG. 1(*a*) between points 8 and 60, where the ruler or the arm could be moved to measure unit or specific distances or values). In the case of dividing a distance into a desired number of equal parts, one needs to first measure the distance with a scale which will give you the desired number of parts and then mark them out.

Figure 2:
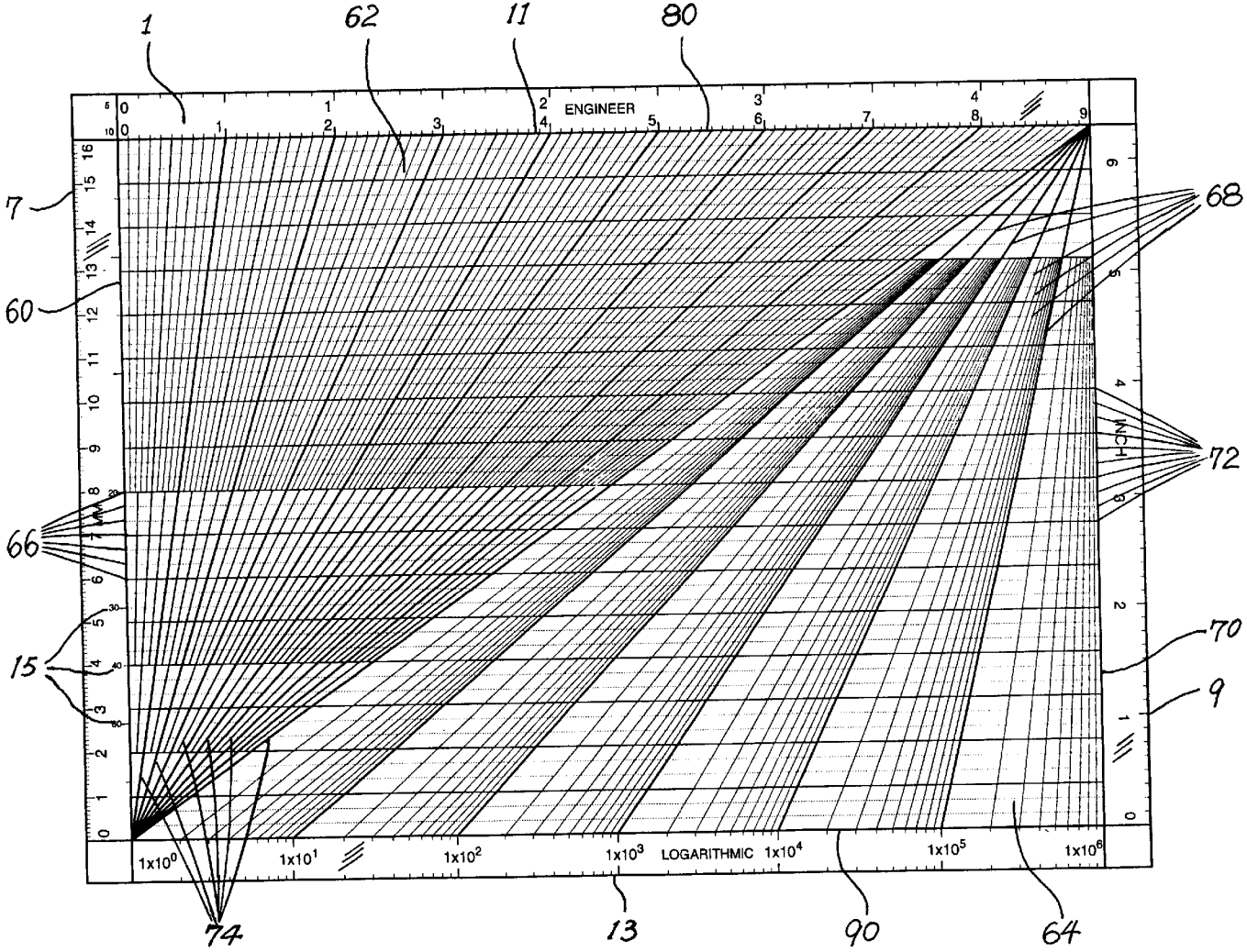
FIG. 2 is a top plan view of a universal scale ruler according to another preferred embodiment of the present invention, the ruler comprising a thin transparent plastic panel containing both linear and logarithmic types of graduations which are composed of ray-like, angularly spaced straight lines emanating from the 0,0 point on the X,Y axes.

FIG. 2 shows a ruler according to another preferred embodiment of the present invention. The ruler shown in FIG. 2 comprises a thin transparent or semitransparent panel 1 of plastic and has left, right, upper and lower straight edges 60, 70, 80 and 90. The panel 1 has been divided into two triangular regions 62 and 64. The triangular region 62 contains a family of inscribed or printed straight lines 74 which or their extensions meet at a point and another family of inscribed or printed straight, horizontal reference lines 66. The lines 74 serve as linear graduations, whose unit lengths along horizontal directions are subdivided into ten equal segments. The triangular region 64 contains a family of inscribed or printed straight lines 68 which or their extensions meet at a point and another family of inscribed or printed horizontal reference lines 72. The lines 68 serve as logarithmic graduations, whose unit lengths are subdivided into nine logarithmic segments, each representing an exponential value. The reference lines 66 and 72 (optional) provide a guidance means in the measurement.

In the case of measuring a distance on a map or a graph using the ruler of FIG. 2, what one needs to do is to first find the right scale on the ruler, which is the same distance as the unit measurement on the reference scale provided by the map or the graph. This can be done by moving the ruler up and down on the reference scale until the right scale is found. The scale can then be used to measure distances directly on the map or graph by moving the universal scale over the map or graph and counting multiples or fractions of the line spacing on the universal scale equated with the units on the underlying map or graph.

Figure 3A:
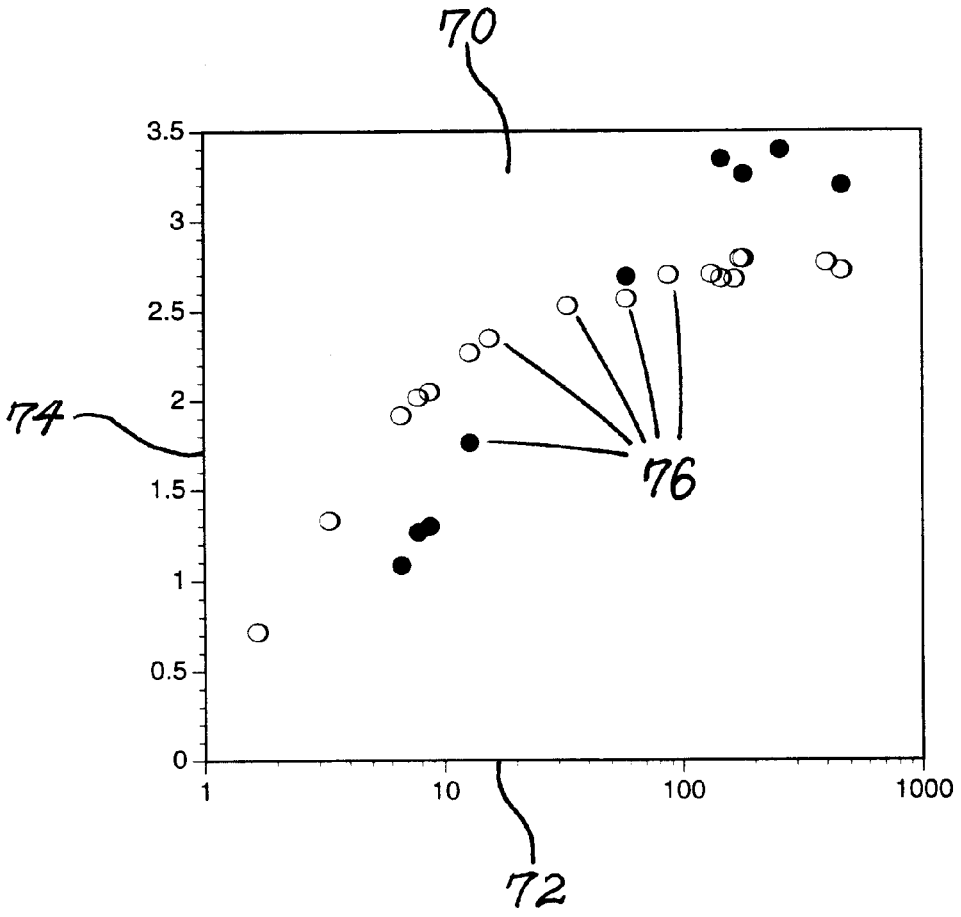
FIGS. 3(*a*), 3(*b*) and 3(*c*) show the use of the logarithmic scale system of the present invention.
Figure 3:
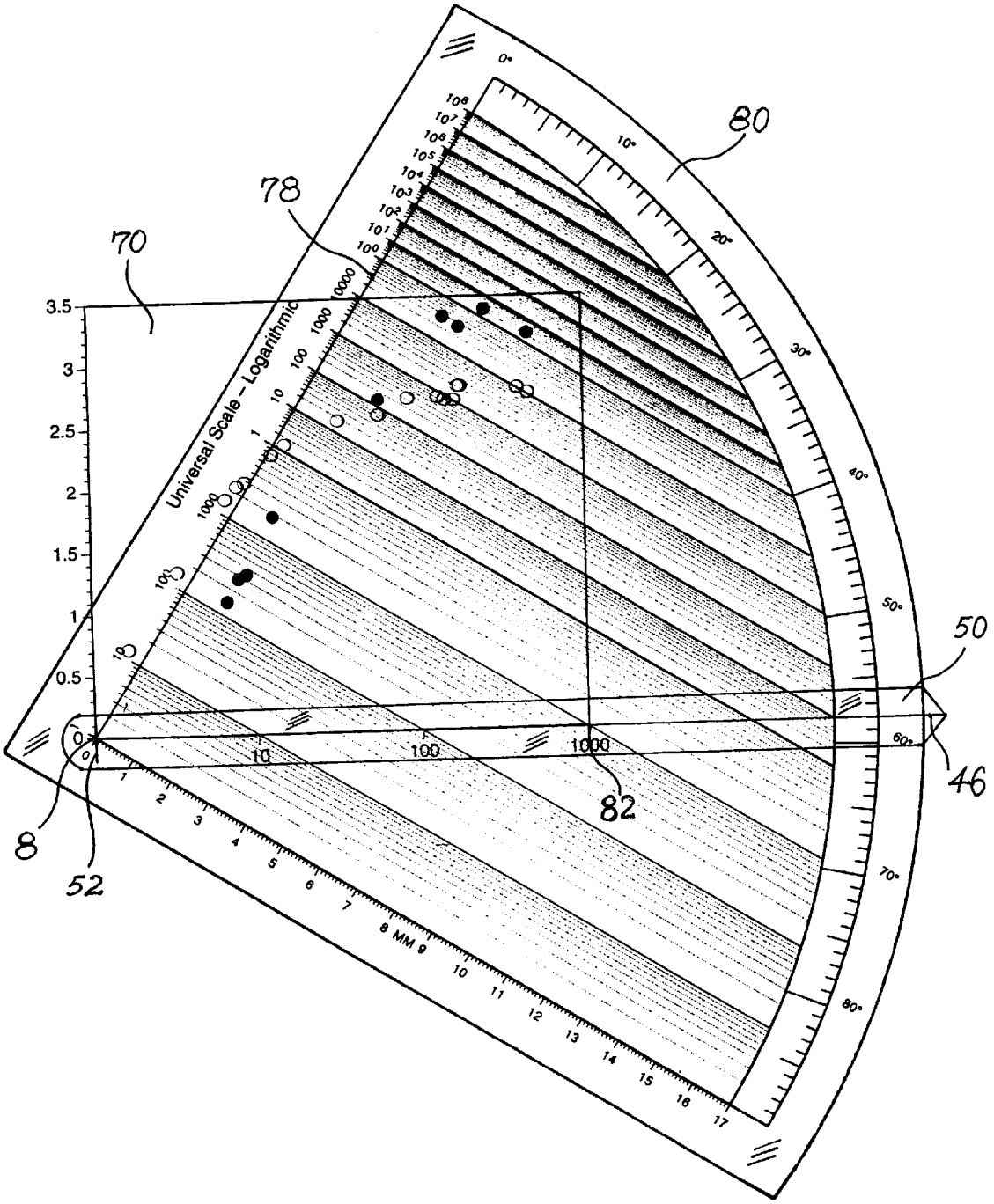
Figure 3:
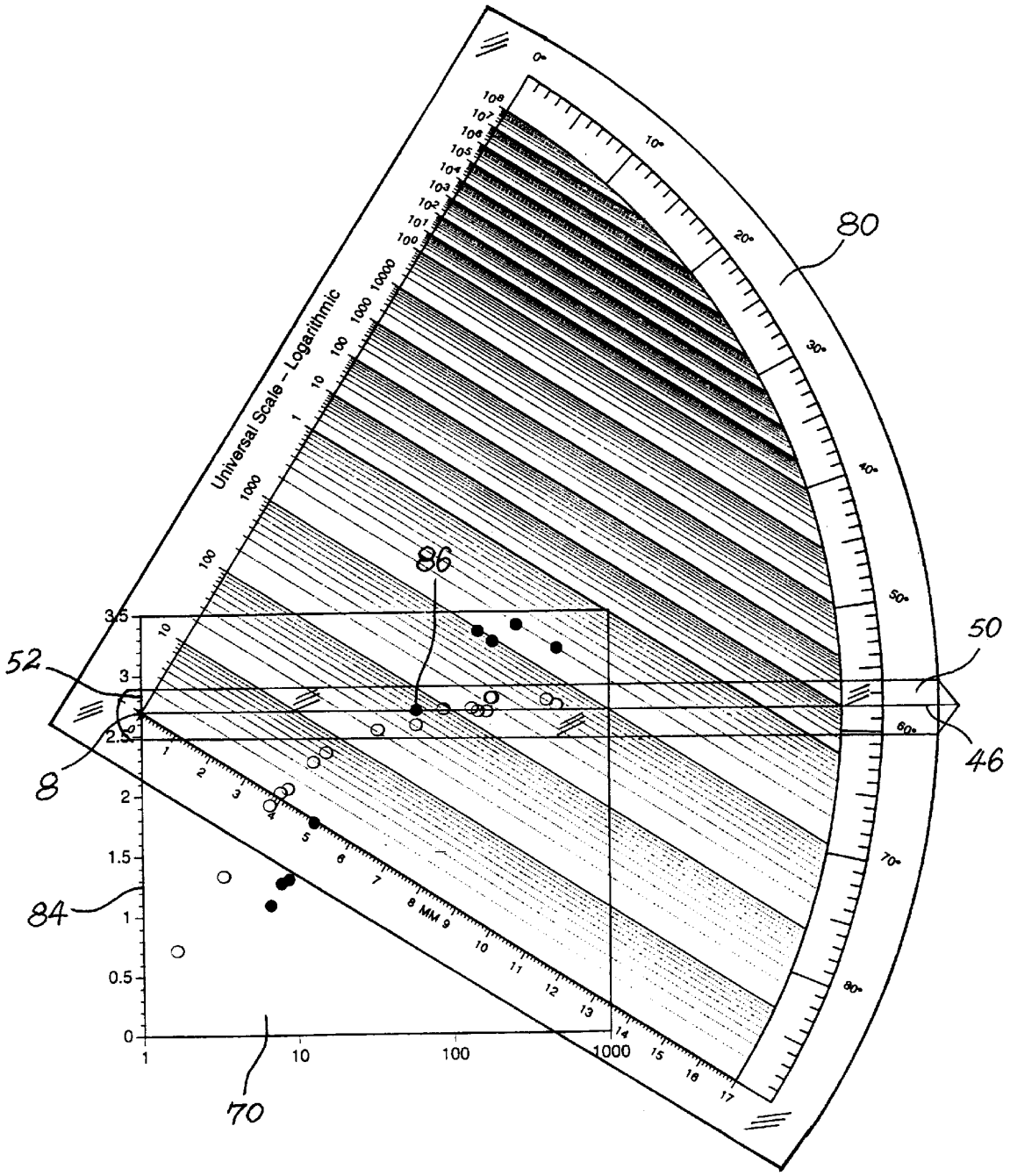

In the case of measuring a distance from a logarithmic graph, similar procedures for the use of the linear graph may be used, as detailed below. The logarithmic scales may be used as follows. FIG. 3(*a*) shows a logarithmic graph 70 having logarithmic values on the X axis 72 and normal values on the Y axis 74. Arbitrary data points 76 are shown on the graph 70. FIG. 3(*b*) shows the graph 70 of FIG. 3(*a*) with a graphic translator 80 of the present inventor overlying the graph 70. The PAR point 8 of the rotating arm 50 is placed at the 0,0 point of the graph 70. The center line 46 of the rotating arm 50 has convenient unit or logarithmic scale marks (not shown) on it. A unit integer major scale (e.g., log base 10 this would be 1, 10, 100, 1000, etc.) on the graph 70 is aligned with the corresponding logarithmic scales on the X or Y axis of the graphic translator 80 (the Y axis 78 is shown with the logarithmic scales here to correspond to the values desired to be measured on the graph). As shown in FIG. 3(*b*), the 1,000 unit mark on the graph 70 and the Y axis 78 intersect under the rotating arm 50, aligning the 1,000 unit lines on the graph 70 and the translator 80. The distance along center line 46 to point 82 corresponds to 1,000 units on the graph. The rotating arm 50 is then secured in position on the translator 80.

The translator 80, with the secured rotating arm 50 in the proper position, can then be moved over the graph 70 as shown in FIG. 3(*c*). The PAR point 8 is placed along the Y axis 84 of the graph 70. The center line 46 of the rotating arm 50 is slid vertically along the Y axis 84 until a point whose reading is desired. A point 86 was arbitrarily selected for this reading. The logarithmic value of the point on graph 70 is read off the logarithmic scale on the graphic translator 80. Its value is seen to be 1 major scale and 5 minor scales, so it has a value of 60. The only approximation which must be done in this reading is to assure as much parallelity between the center line 46 and the X axis of the graph. This can be done by aligning the line 52 of the rotating arm 50 with the Y axis 84 of the graph 70.

The ruler of the present invention not only contains new functions mentioned above but also preserves the merits of conventional rulers. As shown in FIG. 1(*a*), a linear metric scale 7 is marked along the left edge 6 of the flat sheet 1 and a linear inch scale 9 is marked along the lower edge 4 of the flat sheet 1. As shown in FIG. 2, a linear metric scale 7 is marked along the left edge of the ruler 1 and a linear inch scale 9 is marked along the right edge of the ruler 1. Also, a linear engineer scale 11 with 10 divisions to the inch is marked along the upper edge of the ruler 1 and a logarithmic scale 13 is marked along the lower edge of the ruler 1. By doing so, the edges of the ruler serve as ready and convenient rulers. Thus, the combination of scales and functions allows the use of the universal scale by people who would also like to use standard scales.

Also, on the surface of the panel 1, a series of numbers 15 which represent a standard series of engineering scales are labeled along the edge 60. By labeling the standard series of the engineer, architect and/or metric scales on the sides of the ruler, this ruler also serves as a conventional graduated ruler.

As can be seen from FIGS. 1 and 2, another potential difference between the present ruler and conventional rulers may reside in the design of the graduations. The graduations of the present ruler can be made of points or dots instead of the conventional graduations which are made of straight parallel lines perpendicular to the straight measuring edge. The present ruler also has families of lines which can be related in proportion by movement of the rotating arm.

The graphic translators of the present invention may be provided as supplements to other articles of commerce with which they may be regularly used. For example, the linear graphic translator described for use with maps in FIG. 1(*a*) may be inserted into a pocket or slip page of an atlas or other book with significant numbers of maps (e.g., geography book, demographic book) for ready storage for use by the driver, pilot or navigator. The ruler of the invention could similarly be used on a radar detector screen, especially where the scales and distances can be changed at will and so a fixed dimension rule can not be made on the viewing screen.

A plurality of panels having linear engineer type, linear architect type, linear metric type, logarithmic type, and other types of scales may be employed insofar as the user desires. Although certain preferred embodiments have been shown and described, it should be understood that many changes and modifications may be made therein without departing from the spirit and scope of the invention and the appended claims. For example, this type of double scale universal ruler may be described as a universal scale for linear and logarithmic units comprising a set of four rectangular lines which form two sets of axes for two different sets of graphic scales, each of the two sets of axes having a point where the X and Y axes meet at their base values, a line extending between each of said points where the X and Y axes meet constituting a graphic relationship between each set of X and Y values, the X and Y axes on each of two sets of graphic scales being different. A method of using this type of dual scale universal scale would involve:

a) positioning the point at which said at least one of said two sets of axes intersect at a first image point on an underlying figure, b) determining a focus point on said rotating arm which approximates a unit distance or scale between said first image point and a second image point on said underlying figure to establish a scale distance between the point at which said at least two axes intersect and said first image point, c) rotating said rotatable arm so that said focus point overlies one of a family of lines in said universal scale, d) without further rotation of said rotatable arm, moving said universal scale to a map over said underlying figure, e) placing said point at which said at least two axes intersect over a base point on said underlying figure, f) directing said rotating arm so that it crosses over a target point on underlying figure, and g) determining a distance between said base point on said underlying figure and said target point on said underlying by counting a number of the family of lines which said rotating arm crosses between said base point and said target point on said underlying figure.

In the illustrated embodiments, the panel 1 is rectangular in shape. However, the panel 1 is not limited to the rectangular shape, but may be triangular or trapezoidal or semicircular in shape.

Also in the illustrated embodiments, the traces formed by the graduation points happen to be continuous straight lines. Curve-shaped traces or discontinuous line segments may be employed insofar as the spaces between any two adjacent traces along one direction, e.g., the horizontal direction, are equal.

The scale/ruler/translator of the present invention, as previously noted, is provided on a flexible base. This provides an additional function in that the ruler may then be used on surfaces other than only flat surfaces (e.g., non-planar surfaces). The flexibility would allow it to be used on globes (for measuring distances), cylindrical surfaces (e.g., for dividing the circumference into equal segments), conical surfaces, and the like. The linear translation capability will work equally well on the curved surface merely by having the lines conform to the curved surface by the flexibility of the base element with the image thereon.

What is claimed is:

1. A universal scale comprising:

a transparent element having a visible figure thereon with at least two axes which intersect at a point, said figure having a family of lines which define a mathematic order with respect to at least a first one of said axes, said mathematic order being represented by parallelity between members of said family of lines or by perspective parallelity, attached to said point where said at least two axes intersect is a rotating arm which rotates about said point where said at least two axes intersect, said rotating arm having visible markings thereon wherein each of said at least two axes is connected at a distal position by a third axis having alphanumerics along said third axis.

2. The scale of claim 1 wherein said third axis comprises an arcuate line having numerical units defining physical spacing between segments of said arcuate line.

3. A universal scale comprising:

a transparent element having a visible figure thereon with at least two axes which intersect at a point, said figure having a family of lines which define a mathematic order with respect to at least a first one of said axes, said mathematic order being represented by parallelity between members of said family of lines or by perspective parallelity, attached to said point where said at least two axes intersect is a rotating arm which rotates about said point where said at least two axes intersect, said rotating arm having visible markings thereon, wherein said visible markings on said rotating arm comprise numeric intervals and said rotating arm is transparent and said family of lines comprises parallel lines, and wherein each of said at least two axes is connected at a distal position by a third axis having alphanumerics along said third axis.

4. The scale of claim 3 wherein said third axis comprises an arcuate line having numerical units defining physical spacing between segments of said arcuate line.

5. A set of universal rulers according to claim 3 wherein a) there are at least three different transparent elements having a visible figure thereon, each visible figure with at least two axes which intersect at a point, b) said each visible figure having a family of lines which define a mathematic order with respect to at least a first one of said axes, and at least two of said family of lines being different as between at least two of said at least three figures, c) said mathematic order being represented by parallelity between members of said family of lines or by perspective parallelity, d) at said point where said at least two axes intersect is a hole or puncture point for receiving a rotating arm to rotate about said point where said at least two axes intersect.

6. A method of measuring distances on a map using the universal scale of claim 3 comprising:

a) positioning the point at which said at least two axes intersect at a point on a distance scale for said map, b) determining a focus point on said rotating arm which approximates a unit distance between said point on a distance scale and a point on said distance scale underlying said focus point on said rotating arm to establish a scale distance between point at which said at least two axes intersect and said focus point, c) rotating said rotatable arm so that said focus point overlies one of said family of lines, d) without further rotation of said rotatable arm, moving said universal scale to a map using said distance scale, e) placing said point at which said at least two axes intersect over a base point on said map, f) directing said rotating arm so that it crosses over a target point on said map using said distance scale, and g) determining a distance between said base point on said map and said target point on said map by counting a number of the family of lines which said rotating arm crosses between said base point and said target point on said map.

7. The process of claim 6 wherein said family of lines are parallel lines.

8. The process of claim 7 wherein after step c), the rotating arm is secured into place to reduce its ability to rotate.

9. The process of claim 6 wherein there are major parallel lines within said family of lines and minor parallel lines between said major parallel lines which subdivide the major parallel lines into smaller units.

10. A method of measuring with a ruler according to claim 9, comprising the steps of:

a) aligning a longitudinal axis of said rotatable arm with a reference scale to be measured by overlaying said rotatable arm on top of an underlying scale, b) rotating said plate until finding a desired scale on the transparent element to define a uniform value on a pictorial representation associated with said scale, and c) measuring values on said pictorial representation directly with the scale.

11. The process of claim 6 wherein after step c), the rotating arm is secured into place to reduce its ability to rotate.

12. A process for calculating a measurement on a graph having at least one logarithmic scale thereon, said process comprising:

a) providing a graph with at least one logarithmic scale thereon, b) providing a universal scale as recited in claim 3 wherein at least one of said at least two axes comprises a logarithmic scale, c) positioning the point at which said at least two axes intersect at a point on a logarithmic axis or logarithmic scale for said graph, d) determining a focus point on said rotating arm which approximates a unit exponential distance between said point on a logarithmic axis or scale and a point on said logarithmic axis or scale underlying said focus point on said rotating arm to establish a scale exponential distance between said point at which said at least two axes intersect and said focus point, e) rotating said rotatable arm so that said focus point overlies one of said family of lines, f) without further rotation of said rotatable arm, moving said universal scale to a graph using said exponential scale, g) placing said point at which said at least two axes intersect over a base point on said graph, h) directing said rotating arm without rotating it with respect to said transparent element so that it crosses over a target point on said graph using said exponential scale, and i) determining a distance between said base point on said graph and said target point on said graph by counting a number of the family of lines which said rotating arm crosses between said base point an said target point on said graph.

* * * * *

UNITED STATES PATENT AND TRADEMARK OFFICE

CERTIFICATE OF CORRECTION

PATENT NO. : 5,896,671

DATED: Apr. 27, 1999

INVENTOR(S) : Weiping Yu

It is certified that error appears in the above-identified patent and that said Letters Patent is hereby corrected as shown below:

In column 4, line 34, delete "comprises", insert --comprise--, therefore.
In column 5, line 25, delete "has", insert --having--, therefore.
In column 5, line 26, delete "then", insert --the--, therefore.
In column 5, line 32, delete "may connected", insert --may be connected--, therefore.

Signed and Sealed this

Thirtieth Day of May, 2000

*Attest:*

Q. TODD DICKINSON

*Attesting Officer*

*Director of Patents and Trademarks*